US007370513B2

(12) United States Patent
Meyer et al.

(10) Patent No.: US 7,370,513 B2
(45) Date of Patent: May 13, 2008

(54) SYSTEM AND METHOD FOR MONITORING FEATURES OF A BLAST

(75) Inventors: Eric Nichol Meyer, Schoemansville (ZA); Charles Michael Lownds, Rosemount, MN (US)

(73) Assignee: Orica Explosives Technology Pty. Ltd., Victoria (AU)

( * ) Notice: Subject to any disclaimer, the term of this patent is extended or adjusted under 35 U.S.C. 154(b) by 0 days.

(21) Appl. No.: 10/509,119

(22) PCT Filed: Mar. 26, 2003

(86) PCT No.: PCT/ZA03/00041

§ 371 (c)(1),
(2), (4) Date: Jun. 16, 2005

(87) PCT Pub. No.: WO03/083406

PCT Pub. Date: Oct. 9, 2003

(65) Prior Publication Data

US 2005/0247109 A1 Nov. 10, 2005

(30) Foreign Application Priority Data

Mar. 28, 2002 (ZA) ..... 02/2513

(51) Int. Cl.
*G01N 33/22* (2006.01)

(52) U.S. Cl. ..... 73/35.15; 102/217

(58) Field of Classification Search .... 73/35.14–35.16; 102/200, 217

See application file for complete search history.

(56) References Cited

U.S. PATENT DOCUMENTS 2,660,716 A * 11/1953 McFarland ..... 367/55
2,865,463 A * 12/1958 Itria ..... 181/102
2,925,729 A * 2/1960 O'Brien, Jr. ..... 73/35.14
3,027,751 A * 4/1962 Jones ..... 73/35.14
3,381,521 A * 5/1968 Caldecourt et al. ..... 73/35.15
3,408,855 A * 11/1968 Slykhouse ..... 73/35.15
3,572,095 A * 3/1971 Kqwalick ..... 73/35.15
3,852,994 A * 12/1974 Pereda ..... 73/35.15

(Continued)

FOREIGN PATENT DOCUMENTS

EP 0 897 098 A 2/1999

(Continued)

*Primary Examiner*—Hezron Williams
*Assistant Examiner*—Tamiko Bellamy
(74) *Attorney, Agent, or Firm*—Birch, Stewart, Kolasch & Birch, LLP

(57) ABSTRACT

A method of monitoring a feature of a blast such as velocity of detonation (VOD) comprises the steps of providing a detonator 16.1 at a blast site 12. Prior to the blast, a blast control signal path 20, 18.1 is utilized to communicate blast control signals to the detonator. During a period following start of the blast, a blast feature signal communication path 18.1, 20 comprising at least part of the blast control signal path is utilized to communicate a blast feature signal relating to the feature to a remote blast feature monitoring station 26. The blast feature signal is generated by generating a monitoring signal in a conductor arrangement 18.1 connected to die detonator, utilizing a sensor outside of the housing of the detonator to sense changes in a blast feature monitoring parameter of the monitoring signal, and transmitting data relating to the changes to the station 26.

17 Claims, 8 Drawing Sheets

U.S. PATENT DOCUMENTS 4,106,073 A * 8/1978 Hedberg ..... 361/248
4,782,911 A * 11/1988 Dixon et al. ..... 181/107
4,860,653 A * 8/1989 Abouav ..... 102/200
4,976,199 A 12/1990 Beukes et al. ..... 102/200
5,090,321 A * 2/1992 Abouav ..... 102/200
5,099,763 A * 3/1992 Coursen et al. ..... 102/313
5,295,438 A 3/1994 Hill et al. ..... 102/217

FOREIGN PATENT DOCUMENTS

WO WO-00/04337 A 1/2000
ZA 9607019 A * 4/1997

* cited by examiner

SYSTEM AND METHOD FOR MONITORING FEATURES OF A BLAST

TECHNICAL FIELD

THIS invention relates to blasting systems and more particularly to a method and system for monitoring features of a blast, for example velocity of detonation of a main charge.

Rock or soil blasting is usually achieved by drilling at a blast site an array of boreholes, placing in each an initiation device or detonator, and partially filling the holes with explosives. The holes are then usually stemmed with soil or gravel. The initiation devices are selected and interconnected so as to allow the explosive charges in the holes to be detonated by the initiation devices in a desired sequence. There are several features associated with a blast or detonation of the aforementioned kind which are of potential interest, including the time instant of detonation, the velocity of the detonation wave, pressures in the detonating explosive, time of arrival and intensity of shock pressure at an adjacent hole, vertical length of the stemming in the hole, the acceleration history of the burden, ground vibration etc. Detonation velocity is one of the most commonly measured dynamic features of blasting and therefore various methods and systems for monitoring or measuring the velocity of detonation of a main charge are known. In one known approach, a special monitoring circuit is deployed with dedicated conductors extending into the blast holes. The special circuit is energised by a suitable signal generated at a remote site and parameters of the signal during the blast are monitored to ascertain the velocity of detonation. Since blasting is a violent event, the signal generation and monitoring devices in this known method are kept at a significant distance from the holes in which the measurements are being done, and are connected to the measuring circuitry by long electrical cables. It will be appreciated that this special and dedicated circuit is contributing to the cost of the system as well as to labour and time to prepare the blast site.

OBJECT OF THE INVENTION

Accordingly it is an object of the present invention to provide an alternative method and system with which the applicants believe the aforementioned disadvantages may at least be alleviated.

SUMMARY OF THE INVENTION

According to the invention there is provided a method of monitoring at least one feature of a blast, the method comprising the steps of:

- providing at least one detonator at a blast site to cause at least part of the blast;
- prior to the blast, utilizing a blast control signal path extending between a blast controller and the at least one detonator, to communicate blast control signals to the at least one detonator;
- during a period following start of the blast, utilizing a blast feature signal communication path comprising at least part of the data blast control signal path to communicate a blast feature signal relating to at least one feature of the blast to a blast feature monitoring station.

In a preferred form of the method, a plurality of detonators are provided in spaced relation at the blast site and each detonator may be associated with a respective blast control signal path and a respective blast feature signal communication path.

The feature may be velocity of detonation (VOD) of a main charge initiated by the detonator. In a single-shot blast, other features that may be monitored are: time instant of start of detonation, ground vibrations, detonation or explosion pressure in a blast hole and length or depth of the main charge in the blast hole. In a multiple-shot blast, the feature may be any one of the aforementioned plus shock pressure caused by detonation in an adjacent hole, delay time between start of detonations in adjacent holes, to name but a few.

The blast controller and the blast feature monitoring station may be provided at a common location which is remote from the blast site. The respective blast control signal paths may comprise respective conductor arrangements connected to each of said detonators. The respective conductor arrangements may branch from a trunk or main conductor arrangement connected to the blast controller.

In some forms of the method, the blast feature signal may be generated by at least one sensor which is connected to one of the main conductor arrangement and any of the respective conductor arrangements. The at least one sensor is preferably located outside of any detonator housing. The sensor may be in the form of a suitable transducer for generating a blast feature signal in response to pressure, acceleration, strain or any other feature of the blast.

The blast feature signal generated by the at least one sensor may be transmitted to the blast feature monitoring station via the blast feature signal communication path comprising at least part of the main conductor arrangement. Alternatively, the blast feature signal communication path may comprise at least part of a conductor arrangement to which the at least one sensor is connected, and a wireless link.

Other forms of the method may comprise the steps of generating a monitoring signal in a respective conductor arrangement and sensing a change in a blast feature monitoring parameter of the signal as a result of the blast, to provide the blast feature signal.

The monitoring signal may comprise a first signal and a second signal, such as a reflection of the first signal on the conductor arrangement. The blast feature monitoring parameter may relate to a difference in corresponding signal parameters of the first signal and the second signal, such as a difference in phase, amplitude and frequency.

Hence, the method may comprise the steps of causing a signal generator to generate a first signal for propagation on the respective conductor arrangement, to cause a reflection of the first signal, and monitoring changes in a phase and/or amplitude difference between the first signal and the reflection before, during and immediately after detonation.

The first signal may be generated by a signal generator located at the remote blast controller and which is connected to said respective conductor arrangement by said main conductor arrangement.

Alternatively, the first signal may be generated in the respective conductor arrangement by a signal generator located at the remote blast controller and data relating to the change may be transmitted from a sensor connected to the respective conductor arrangement via a wireless link to the remote blast feature monitoring station.

Further alternatively, the first signal may be generated by a signal generator connected directly to the respective conductor arrangement and data relating to the change may be transmitted by a sensor connected to the conductor arrangement via a wireless link to the remote feature monitoring station.

Also according to the invention there is provided a method of monitoring a feature of a blast, the method comprising the steps of:

- providing a conductor arrangement connected to a detonator and which detonator causes part of the blast;
- generating a monitoring signal in the conductor arrangement;
- sensing a change in a blast feature monitoring parameter of the signal as a result of the blast; and
- processing data relating to the change for providing data relating to the feature.

The feature may be velocity of detonation (VOD) of a main charge initiated by the detonator and at least part of the conductor arrangement may be embedded in the main charge.

The conductor arrangement may be connected to the detonator to control the detonator, for example by transmitting at least one of programming data, a fire signal and power to the detonator from a remote source, such as a blast controller. The conductor arrangement may comprise a pair of twisted conductors.

The monitoring signal may comprise a first signal and a derivative signal, such as a reflection of the first signal on the conductor. The blast feature monitoring parameter may relate to a difference between corresponding signal parameters of the first signal and the derivative signal, such as a difference in phase, amplitude and frequency.

A presently preferred form of the method comprises the steps of causing a signal generator to generate a first signal for propagation on the conductor arrangement to cause a reflection of the first signal, and monitoring changes in a phase and/or amplitude difference between the first signal and the reflection before, during and immediately after detonation.

In a first form of the method, the first signal may be generated by a signal generator at a remote blast controller which is connected to said conductor arrangement by a main conductor arrangement.

In a second form of the method, the first signal may be generated by a signal generator at the remote blast controller and data relating to the changes is transmitted from a sensor connected to the conductor arrangement via a wireless link to a remote blast feature monitoring and data processing station.

In a third form of the method, the first signal may be generated by a signal generator connected directly to the conductor arrangement and data relating to the changes is transmitted by a sensor connected to the conductor arrangement via a wireless link to a remote blast feature monitoring and data processing station.

According to another aspect of the invention, a system for monitoring at least one feature of a blast comprises:

- at least one detonator located at a blast site to cause at least part of the blast;
- a blast control signal path extending between a blast controller and the at least one detonator, to communicate blast control signals to the at least one detonator;
- a sensor sensitive to a feature of the blast;
- a blast feature signal communication path comprising at least part of the blast control signal path to transmit a blast feature signal relating to the feature of the blast to a remote blast feature monitoring station.

The sensor is preferably located outside a housing of the at least one detonator.

The sensor may comprise a separate device connected to a conductor arrangement which is connected to the detonator. In other embodiments, the sensor may comprise at least part of said conductor arrangement connected to the detonator.

Further according to the invention there is provided a system for monitoring a feature of a blast, the system comprising:

- a detonator for causing at least part of the blast;
- a conductor arrangement connected to the detonator for controlling operation of the detonator;
- a monitoring signal generator arranged to generate a monitoring signal in the conductor arrangement; and
- a sensor for sensing changes in a blast feature monitoring parameter of the monitoring signal as a result of the blast.

The sensor is preferably located outside a housing of the detonator.

In a first embodiment of the system the signal generator is connected to the conductor arrangement by a main conductor arrangement extending between the conductor arrangement and the signal generator.

The signal generator may form part of or be connectable to a blast controller.

The sensor may comprise a sensing circuit forming part of or which is connectable to the blast controller.

In a second embodiment the sensor may be connected directly to the conductor arrangement and data relating to the changes may be transmitted by the sensing circuit via a wireless link to a remote blast feature monitoring and data processing system.

The sensor may be connected to the main conductor arrangement at a point where the conductor arrangement branches from a main conductor arrangement.

In a third embodiment the signal generator and the sensor may be connected directly to the conductor arrangement and the data relating to changes in the blast feature monitoring parameter may be transmitted via a wireless link from the sensor to a remote blast feature monitoring and data processing system.

The conductor arrangement and the main conductor arrangement may comprise a pair of twisted conductors.

The wireless link may comprise an RF transceiver at both ends hereof.

BRIEF DESCRIPTION OF THE ACCOMPANYING DIAGRAMS

The invention will now further be described, by way of example only, with reference to the accompanying diagrams wherein.

DESCRIPTION OF PREFERRED EMBODIMENTS OF THE INVENTION

Figure 1:
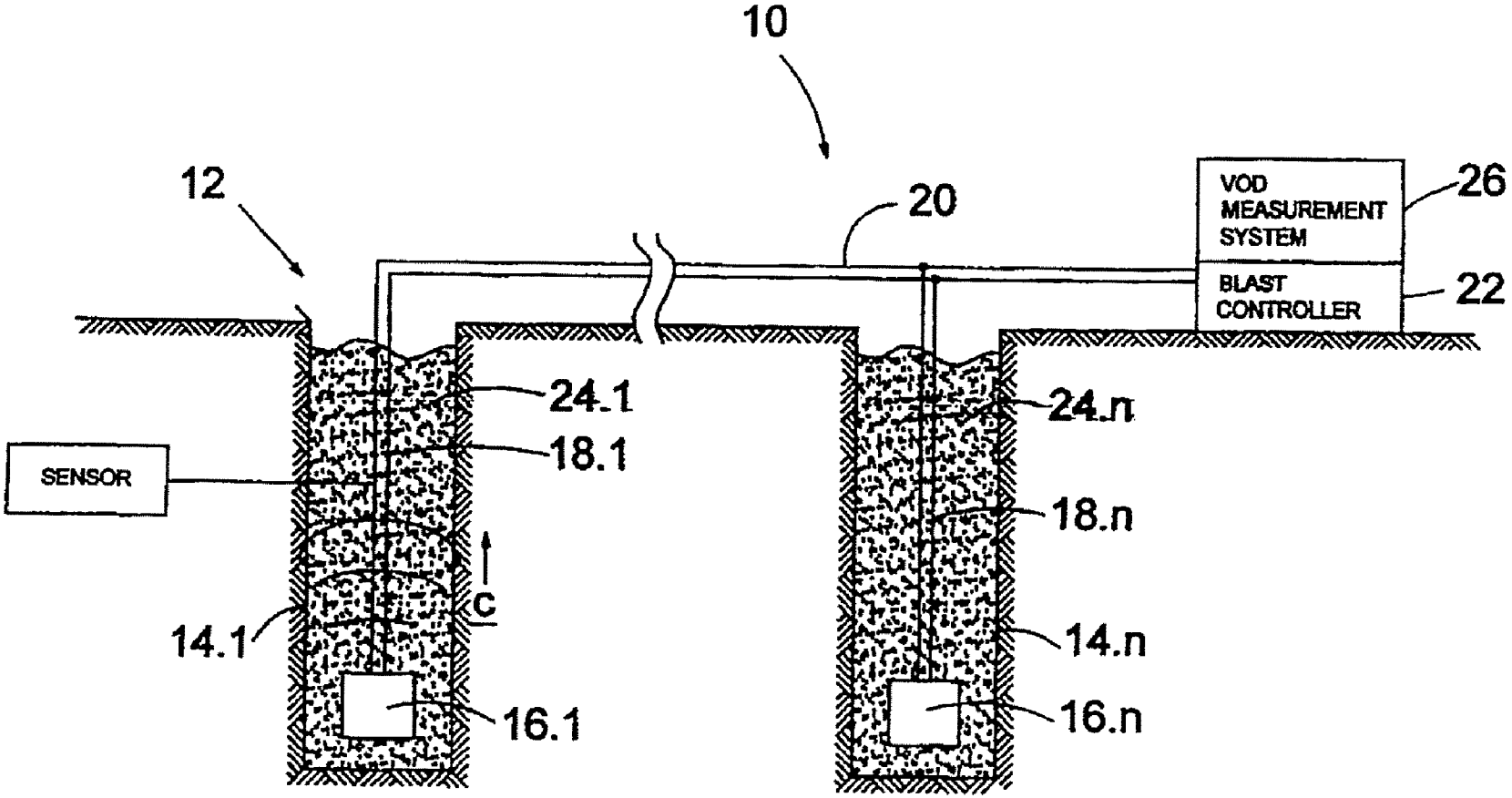
FIG. 1 is a block diagram of a first embodiment of a detonation system comprising a blast feature monitoring system according to the invention in the form of a VOD measurement system.

In FIG. 1 there is shown a block diagram of a first embodiment of a detonation system comprising a blast feature monitoring system according to the invention in the form of a velocity of detonation (VOD) measurement system designated by the reference numeral 10.

The detonation system is shown deployed at a blast site 12 defining a plurality of blast holes 14.1 to 14.n. In each of the holes there is provided an electric, alternatively and electronic detonator 16.1 to 16.n respectively. Each detonator 16.1 to 16.n is connected via a respective branch or "down the hole" lead conductor arrangement 18.1 to 18.n to main lead conductor arrangement 20 which in turn is connected to a blast controller 22. Each lead conductor arrangement 20 and 18.1 to 18.n preferably comprises a known twisted pair of conductors.

Each of holes 14.1 to 14.n is filled with a respective body 24.1 to 24.n of a main charge. The conductor arrangements 18.1 to 18.n are at least partially embedded in respective bodies 24.1 to 24.n. The body of main charge may comprise any one or more of known emulsion explosives, ANFO, blends thereof, nitroglycerin and watergell explosives. It is known that once a main charge is detonated by the detonator 16.1 in known manner, the detonation propagates in the body of main charge as shown at C. The speed of propagation is referred to as the velocity of detonation (VOD) and is measured in meters per second or feet per second.

In use, the detonators 16.1 to 16.n are programmed and/or controlled by blast controller 22 in known manner by transmitting control and programming data, such as delay time data, on conductor arrangements 20 and 18.1 to 18.n which constitute a blast control signal path to each detonator. Power is also transmitted to the detonators to be stored on respective local charge storage devices (not shown). A common "fire"-signal is then transmitted on the aforementioned control signal paths. Upon receipt of the "fire"-signal, and also in known manner, each detonator starts to process respective delay time data. At the end of a respective delay time, a fuse in the detonator is energized by charge stored on the charge storage device, to cause detonation. As stated hereinbefore, the detonation propagates as shown at C and in the process disintegrates at least part of the respective branch conductor arrangement 18.1.

A VOD measurement system 26 according to the invention utilizes changes in one or more blast feature monitoring parameters of a monitoring signal transmitted on the conductor arrangements 20 and 18.1 to 18.n and which act as a blast feature transducer or sensor, to determine the VOD, as will hereafter be described. Such monitoring parameters may include phase, amplitude, frequency etc or changes in differences between values of similar signal parameters of a first signal and a second or derivative signal, such as a reflection of the first signal on the conductor arrangement. The blast controller 22 and the blast feature monitoring station 26 are provided at a common location remote from the last site.

Figure 4:
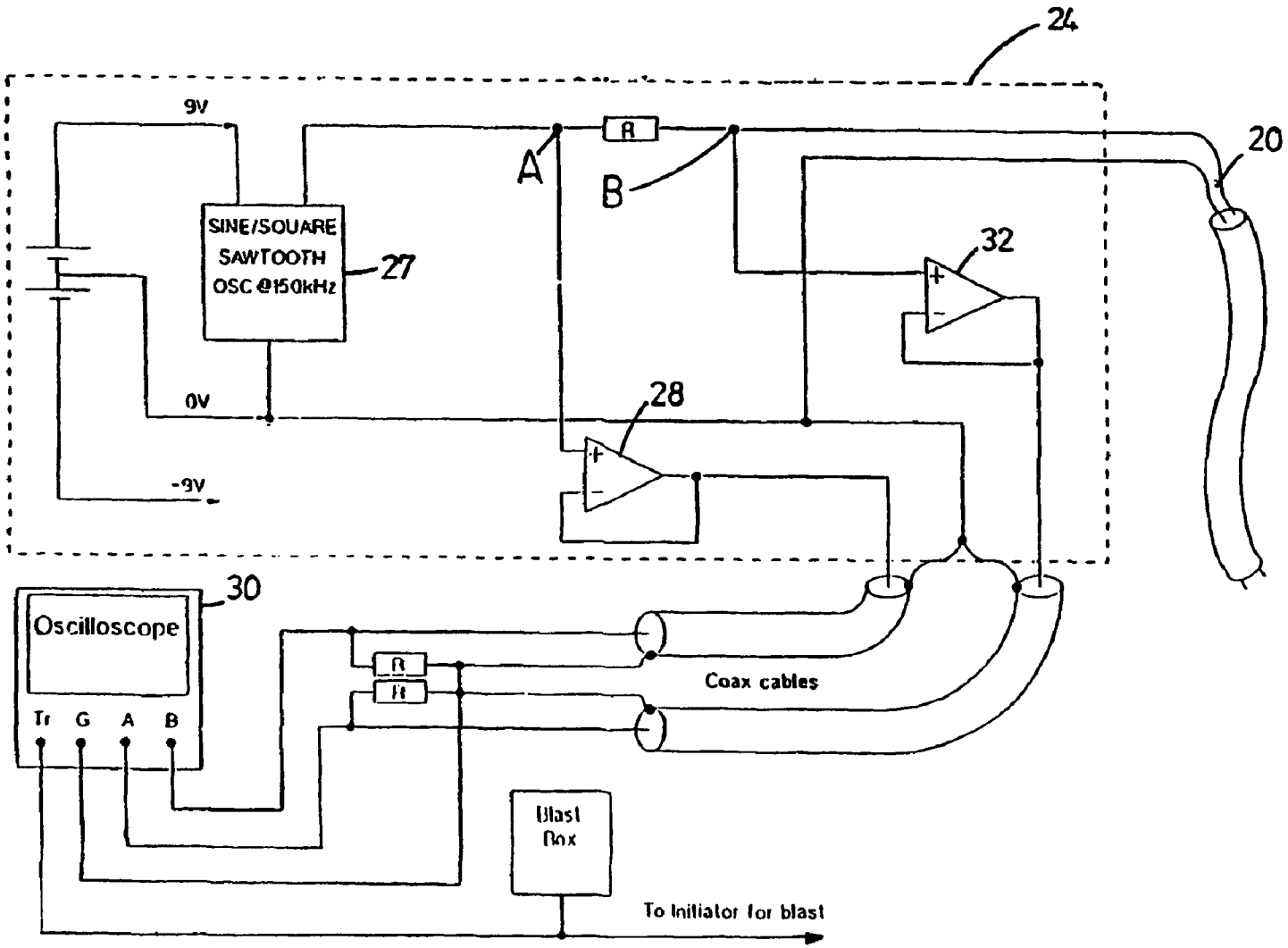
FIG. 4 is a basic block diagram of part of a VOD measurement system.

In FIG. 4 there is shown a block diagram of part of one example of a VOD measurement system 24 falling within the scope of the present invention.

The system comprises a monitoring signal generator 27 which is connected to the main lead conductor arrangement 20. The monitoring signal is sensed at point A at a blast feature monitoring station 26 and connected via suitable circuitry 28 to a waveform recorder in the form of an oscilloscope 30, for example. Signals on line 20 are also sensed at point B and fed via circuitry 32 to the recorder 30. At the monitoring station, resulting signals are reproduced for comparison and analysis. This comparison and analysis may be computerized and may yield output data relating to various features of a blast, including VOD.

Figure 5:
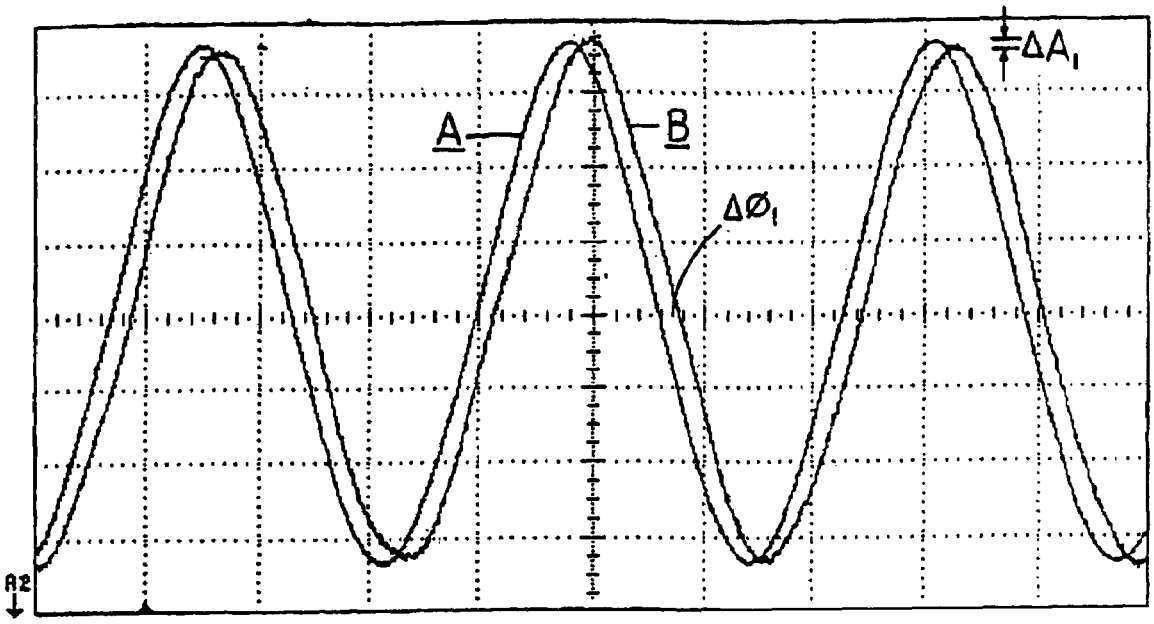
FIG. 5 depicts waveforms measured at points A and B in FIG. 4, before detonation of a main charge.

In FIG. 5 there are shown typical waveforms at points A and B before detonation. As will be clear, the monitoring signal at A is in the form of a sine wave having a frequency of about 150 kHz. The second signal at point B represents a reflection on the conductor arrangements. It will be seen that there is an initial phase difference $\Delta Ø_1$ between the two signals as well as an initial amplitude difference $\Delta A_1$. It has been found that these differences are proportional to the length of the conductor arrangements 18.1 and 20. It has also been found that for the conductor arrangements used in an experiment, a phase difference of 15-20 degrees represents a length of about 30 meters.

Figure 6:
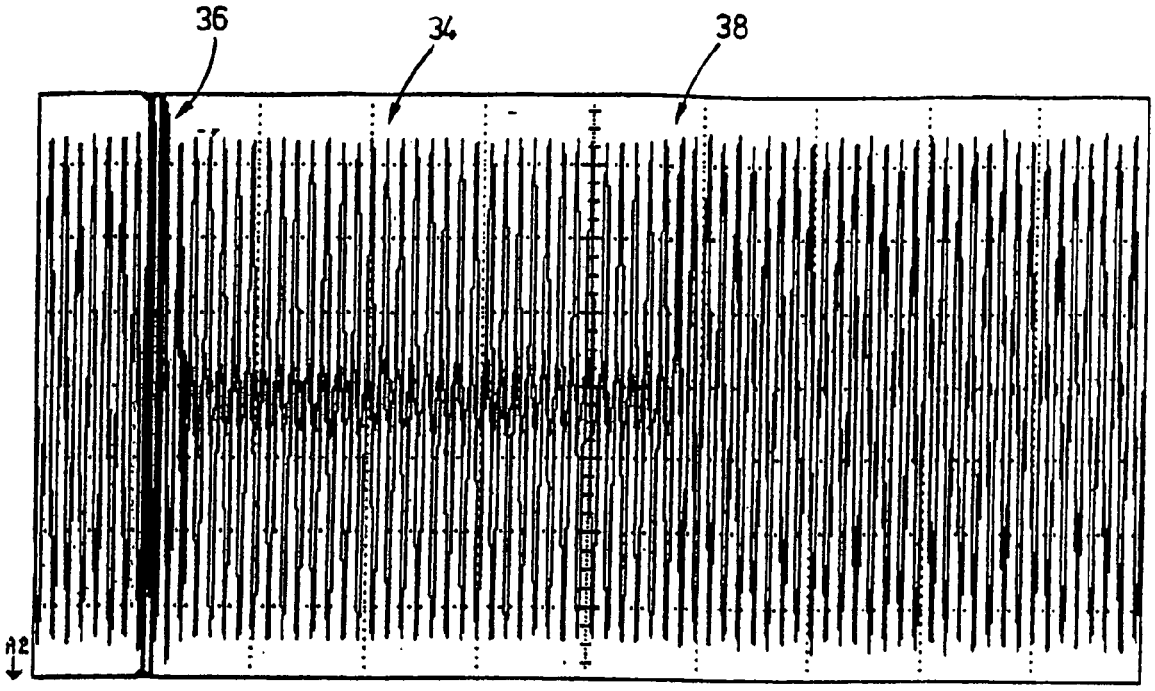
FIG. 6 depicts similar waveforms during a period from before detonation, during detonation until after the detonation.

In FIG. 6, there are shown the waveforms at A and B, before, during and after the detonation. Start of detonation is shown at point 36 and end of detonation is shown at point 38. The detonation propagates through the charge body during period 34, as hereinbefore described.

Figure 7:
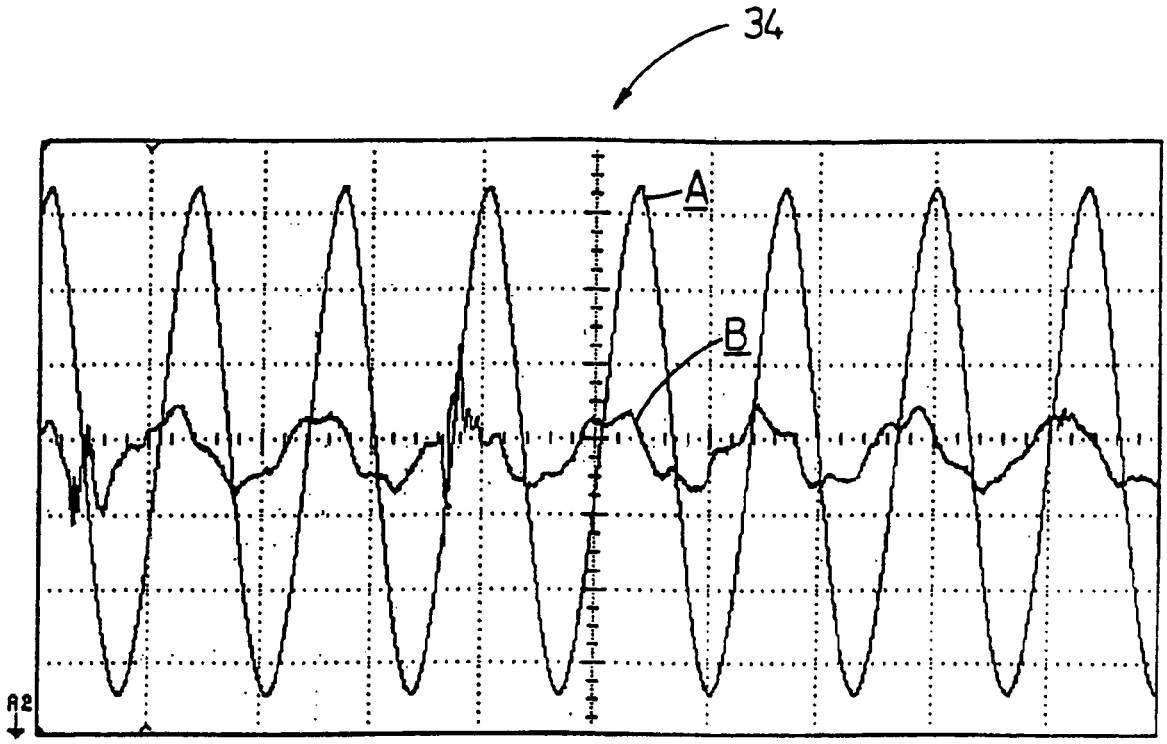
FIG. 7 depicts similar waveforms on a smaller time scale during the detonation.

In FIG. 7 there are shown the signals at A and B during part of period 34, but on a smaller time base. A change in amplitude of the signal at B is clearly visible as is a charge in the aforementioned initial phase difference $\Delta Ø_1$.

Figure 8:
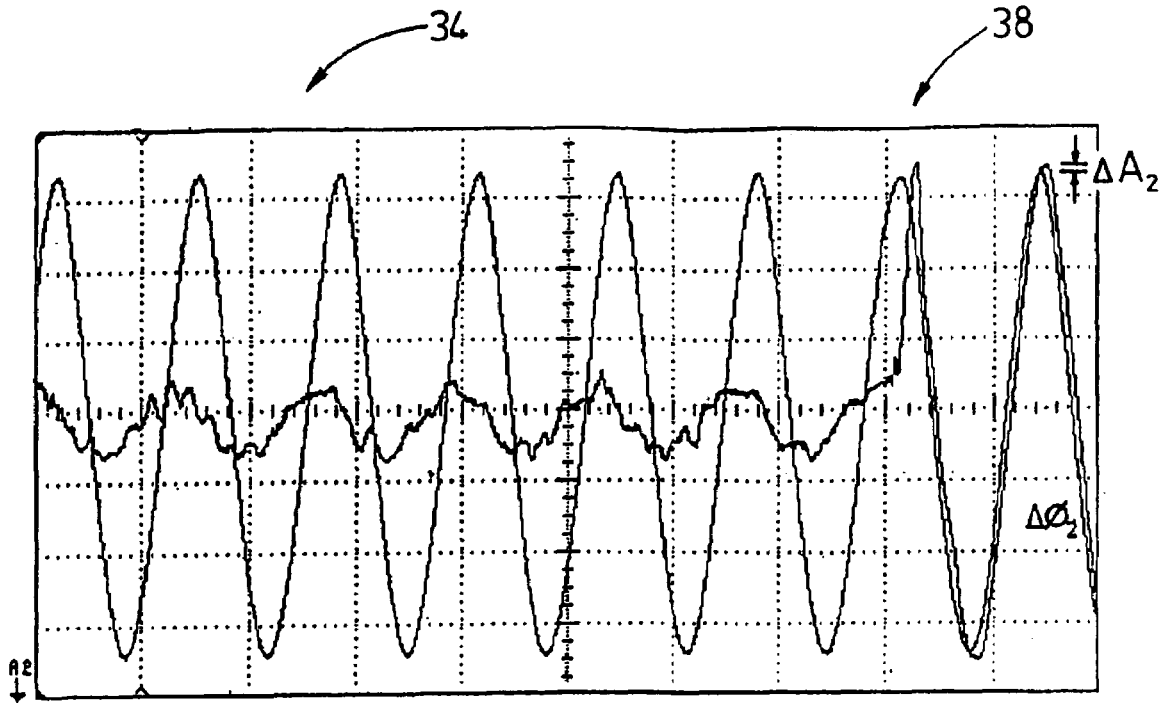
FIG. 8 depicts similar waveforms also on the smaller time scale, but towards the end of the detonation.

In FIG. 8 there are shown the waveforms at A and B towards the end of period 34 and after the end of detonation at point 38.

After point 38, the phase difference is $\Delta Ø_2$ and which has been determined to indicate a conductor arrangement length of 28 meters. The time period 34 of detonation is determined at 240 μs. Similar measurements for the length of the conductor arrangements may be made on the bases of changes in the difference between the amplitudes $\Delta A_2$-$\Delta A_1$.

$$\text{The } VOD \text{ is determined by: } = \frac{\text{change in conductor arrangement length}}{\text{time period 34}} = \frac{2\text{ m}}{240\ \mu\text{s}} = 8333\text{ m/s}$$

Figure 2:
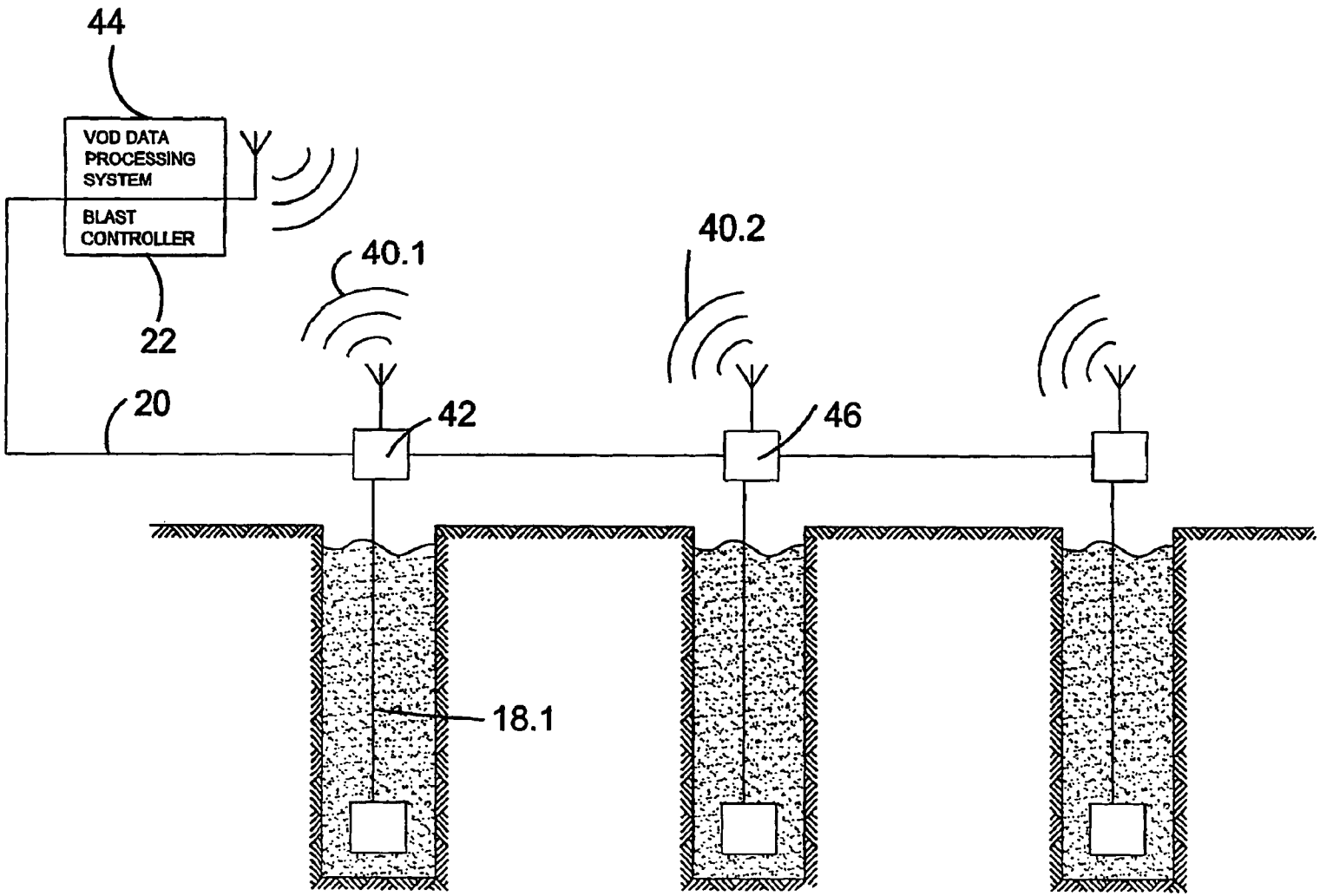
FIG. 2 is a block diagram of a second embodiment of the system according to the invention.

In FIG. 2 there is shown another embodiment of the VOD measurement system according to the invention. In this embodiment data relating to blast feature monitoring parameters derived from a monitoring signal propagating in conductor arrangement 18.1 is transmitted via a wireless link 40.1 by sensor 42 connected to conductor arrangement 18.1 to the monitoring station in the form of a VOD data processing system 44. Similarly data relating to similar parameters derived from a monitoring signal propagation in conductor arrangement 18.2 is transmitted by sensor 46 via wireless link 40.2 to the VOD data processing system 44.

Figure 3:
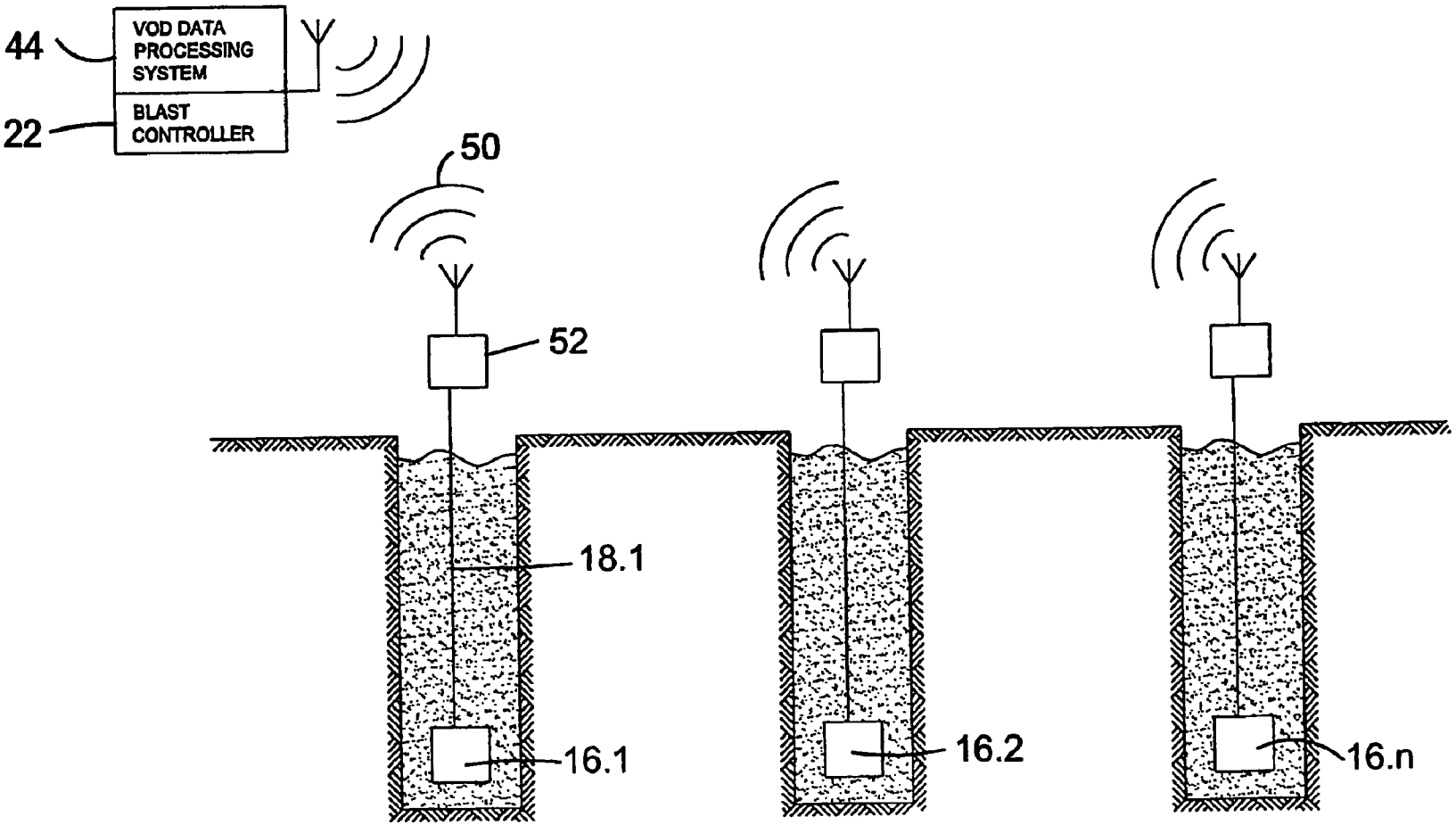
FIG. 3 is a block diagram of a third embodiment of the system according to the invention.

In FIG. 3 there is shown a system wherein main lead conductor arrangement 20 for conveying programming data, power and the "fire"-signal to the detonators 16.1 to 16.n is replaced by a wireless system.

As in the case of the system in FIG. 2, data relating to the blast feature monitoring parameters is transmitted via a wireless link 50 to VOD data processing system 44 by sensor 52 which is connected to conductor arrangement 18.1. The monitoring signal may be generated by a signal generator (not shown) forming part of sensor 52.

It will be appreciated that other aspects or features of a blast or shots in a multi shot blast may also be monitored and/or measured by utilizing monitoring parameters and changes in monitoring parameters of a monitoring signal. Such aspects include: time instant of start of detonation, shock pressure from detonation in adjacent hole, ground vibrations, detonation or exploration pressure in a hole, delay between detonations in adjacent holes, length of main charge body, etc.

Referring again to FIG. 1, in other embodiments a separate transducer or sensor located outside the housing of any detonator may be utilized to generate the blast feature signal. In these embodiments the transducer is connected to the main conductor arrangement 20 or to a respective branch conductor arrangements 18.1 to 18.1n as shown, so that a blast feature signal communication path for transmitting the blast feature signal to a remote blast feature monitoring station, such as VOD measurement system 26, comprises at least part of a data control signal path 20, 18.1 to 18.n extending between the blast controller 22 and the detonators.

The invention claimed is:

1. A method of monitoring a feature of a blast, the method comprising the steps of:

providing a conductor arrangement connected to a detonator for providing blast control signals to the detonator from a remote blast controller and which detonator causes part of the blast;

generating a monitoring signal in the conductor arrangement;

sensing a change in a blast feature monitoring parameter of the signal as a result of the blast; and processing data relating to the change for providing data relating to the feature, wherein the monitoring signal comprises a first signal and a derivative signal of the first signal.

2. A method as claimed in claim 1 wherein the feature is velocity of detonation (VOD) of a main charge initiated by the detonator.

3. A method as claimed in claim 1 or claim 2 wherein the conductor arrangement is connected to the detonator to control the detonator.

4. A method as claimed in claim 1 wherein the conductor arrangement comprises a pair of twisted conductors.

5. A method as claimed in claim 1 wherein the blast feature monitoring parameter relates to a differences between corresponding signal parameters of the first signal and the derivative signal.

6. A method as claimed in claim 5 comprising the steps of causing a signal generator to generate the first signal for propagation on the conductor arrangement, generating a derivative signal by causing a reflection of the first signal, and monitoring changes in the difference in corresponding signal parameters of the first signal and the reflection.

7. A method as claimed in claim 1 wherein the first signal is generated by a signal generator at a remote blast controller which is connected to said conductor arrangement by a main conductor arrangement and which is also connected to a blast feature monitoring station.

8. A method as claimed in claim 6 wherein the first signal is generated by a signal generator at a remote blast controller and wherein data relating to the changes is transmitted from a sensor connected to the conductor arrangement via a wireless link to a remote blast feature monitoring station.

9. A method as claimed in claim 6 wherein the first signal is generated by a signal generator connected directly to the conductor arrangement and wherein data relating to the changes is transmitted by a sensor connected to the conductor arrangement via a wireless link to a remote blast feature monitoring station.

10. A system for monitoring a feature of a blast, the system comprising:

a detonator for causing at least part of the blast;

a conductor arrangement connected to the detonator for controlling operation of the detonator from a remote blast controller;

a monitoring signal generator arranged to generate a monitoring signal in the conductor arrangement, wherein the monitoring signal comprises a first signal and a derivative signal of the first signal; and a sensor for sensing changes in a blast feature monitoring parameter of the monitoring signal as a result of the blast.

11. A system as claimed in claim 10 wherein the sensor is located outside of a housing of the detonator.

12. A system as claimed in claim 10 or claim 11 wherein the signal generator is connected to the conductor arrangement by a main conductor arrangement extending between the conductor arrangement and the signal generator.

13. A system as claimed in claim 10 wherein the signal generator forms part of a blast controller.

14. A system as claimed in claim 10 wherein the sensor comprises a sensing circuit forming part of the blast controller.

15. A system as claimed in claim 10 wherein the sensor is connected directly to the conductor arrangement and wherein the data relating to the changes is transmitted from the sensor via a wireless link to a remote blast feature monitoring station.

16. A system as claimed in claim 15 wherein the sensor is connected to the conductor arrangement at a point where the conductor arrangement branches from a main conductor arrangement.

17. A system as claimed in claim 10 wherein the signal generator and the sensor are connected directly to the conductor arrangement and wherein the data relating to changes in the blast feature monitoring parameter is transmitted via a wireless link from the sensor to a remote blast feature monitoring station.

* * * * *